United States Patent [19]

Goddard

[11] 4,232,092

[45] Nov. 4, 1980

[54] METHOD OF AND MEANS FOR PRECISION MOUNTING OF MEMBERS ON ELONGATE METALLIC SUPPORTING STRUCTURE

[75] Inventor: Denis A. Goddard, Beloit, Wis.

[73] Assignee: Beloit Corporation, Beloit, Wis.

[21] Appl. No.: 963,447

[22] Filed: Nov. 24, 1978

[51] Int. Cl.[2] ..... D12G 9/00

[52] U.S. Cl. ..... 428/542; 428/78; 428/131; 156/153; 156/154; 162/352

[58] Field of Search ..... 162/352, 374; 156/153, 156/154; 428/78, 131, 137, 542

[56] References Cited

U.S. PATENT DOCUMENTS

| | | | |
|---|---|---|---|
| 3,574,056 | 4/1971 | Jud et al. | 162/352 |
| 3,585,105 | 6/1971 | Stuebe | 162/352 X |
| 3,793,140 | 2/1974 | Corbellini | 162/352 |
| 3,928,125 | 12/1975 | Poeschl | 162/352 |
| 4,004,969 | 1/1977 | Beauchemin | 162/352 |

*Primary Examiner*—Marion McCamish

*Attorney, Agent, or Firm*—Hill, Van Santen, Steadman, Chiara & Simpson

[57] ABSTRACT

Members, such as paper machine forming board drainage foils, and the like, are adapted to be mounted in a predetermined substantially accurate attitude unaffected by possible irregularities on a metallic supporting structure, by providing the supporting structure with fixedly secured non-warping nonmetallic base means which is machined substantially accurately to receive and mount the members.

18 Claims, 6 Drawing Figures

Fig 1
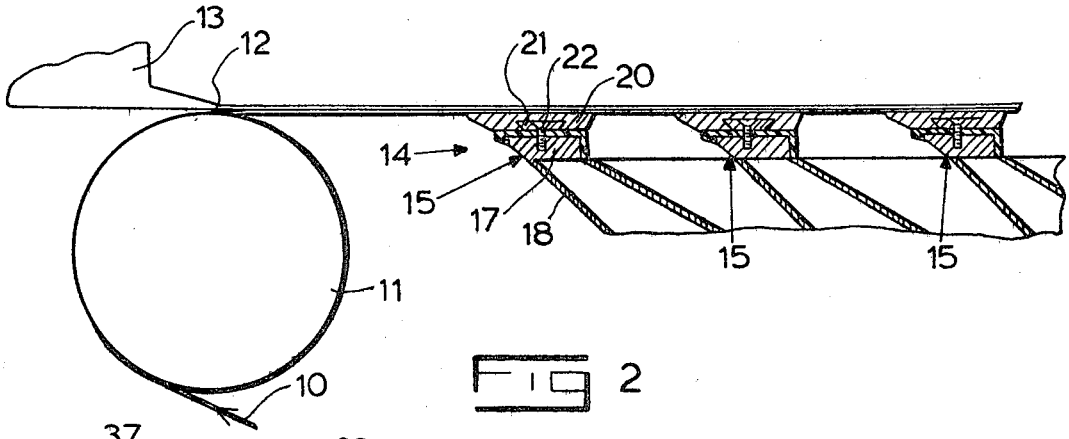
Fig 2
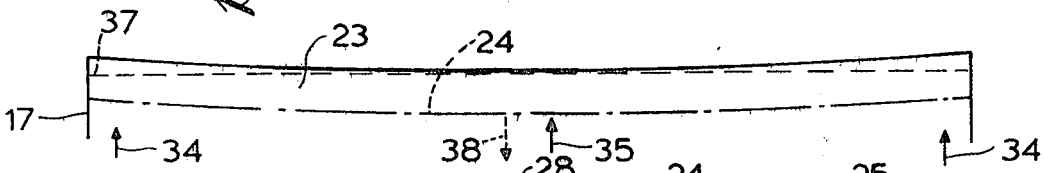
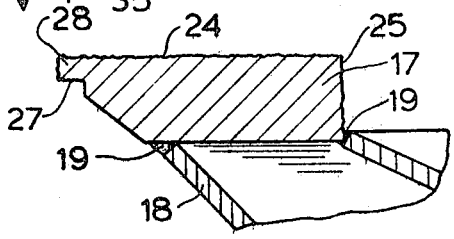
Fig 3
Fig 4
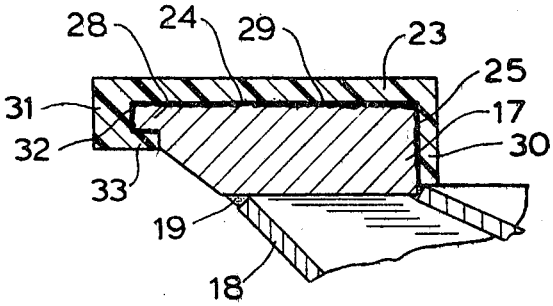
Fig 5
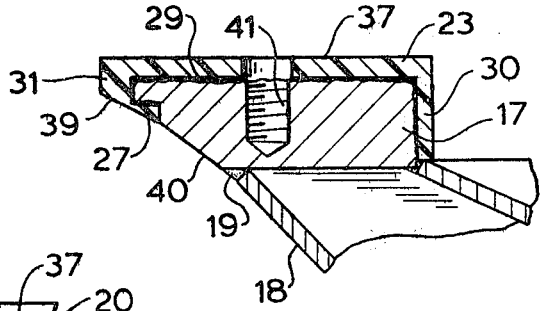
Fig 6
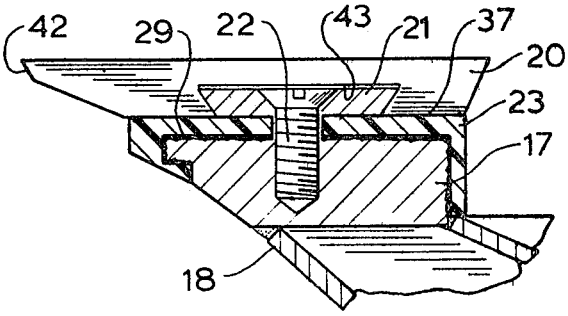

METHOD OF AND MEANS FOR PRECISION MOUNTING OF MEMBERS ON ELONGATE METALLIC SUPPORTING STRUCTURE

This invention relates to a new and improved method of and means for precision mounting of members on elongate metallic supporting structure, and is particularly useful in mounting paper machine drainage foils.

Maintaining the accuracy of elongate machined metallic supporting structures, such as the forming board bars which extend across paper making machines under a forming wire to support water stripping foils, has presented a problem which has long plagued the fabricators of such apparatus. In general, the problem arises from the fact that any mechanical, i.e. machining, removal of metal at reasonable production rates induces high compression stresses and thus warpage irregularities in the machined surface, and in particular any surface on which one or more members must be mounted in a predetermined substantially accurate attitude for use. The problem is intensified in stainless steel parts which are relatively slender and where there is more machining for metal removal on one side of the part. The fabricators have necessarily been required to spend a great deal of time trying to compensate for the machining stresses, often resulting in a complicated guessing game requiring numerous setups. Almost invariably, the exact or precise mounted attitude of the member or members such as paper machine forming board drainage foils is not attained, and performance is, therefore, not as it should be.

By way of example, the problem has been especially prevalent in respect to mounting of the water stripping foils of the forming boards under paper machine forming wires because of the great length of the supporting bars which are not uncommonly up to 25 to 30 feet long in modern paper machines, as pointed out, representatively, in U.S. Pat. No. 3,574,056. As disclosed in that patent, the foil-supporting bars are extensively machined with dove tail or similar configuration thereon to receive complementally machined carrier means on which are mounted foil members. The problem of machining stress warpage and the difficulties noted hereinabove as arising therefrom are inherent in the disclosure of the noted patent.

Because of their length, the forming board supporting bars sag between their ends, that is they assume a catenary which must be compensated for by some means to enable support of the drainage foils complementary to the forming wire as it leaves the adjacent breast or couch roll which due to its length may also sag, but to a substantially less extent than the thin i.e. much smaller cross-sectional mass, forming board supporting bars. On the other hand, if the breast roll is of the type in which the normal sag is compensated by internal means expanding the roll toward its longitudinal center to compensate for the tendency to sag, there may be an upward bow in the forming wire rather than a downward bow. Whichever way the forming wire may bow on leaving the breast roll, complementary adjustment must be made in the attitude of the water stripping foils.

U.S. Pat. No. 3,585,105 has proposed to solve the problem by providing a system of fluid actuated bellows devices under the forming board bars to control the bars and thereby the water stripping foils to match the breast roll at any given operating condition so that the forming wire will travel uniformly onto the forming board. Such dynamic control of the forming board involves a considerable investment in the control devices and requires a hydraulic or pneumatic control system for the device. In addition, the arrangement proposed by this patent requires space for the control devices which may not be available in a compact paper machine arrangement, or at least is required to occupy space which may be used to better advantage in the machine.

An important object ot the present invention is to provide a new and improved method of and means for precision mounting of members on elongate metallic supporting structure, particularly useful in mounting paper machine forming board drainage foils, and which will overcome the disadvantages, drawbacks, inefficiencies, shortcomings and problems inherent in prior structures of this type.

In an embodiment of this invention, there is provided a method of precision mounting of members on elongate metallic supporting structure, comprising forming said metallic supporting structure in a manner to at least minimize warpage, preparing an area along substantially the full length of said supporting structure for receiving mounting base means on said area, applying and fixedly securing to said area mounting base means comprising easily machinable nonmetallic material which is substantially free from tendency to warp during machining and extending in the form of a continuous strip covering said area, and after said applying and securing of said base means substantially accurately machining an exposed receiving surface on said base means for receiving and mounting said members on said receiving surface in a predetermined substantially accurate attitude unaffected by irregularities that may be present in said area and which irregularities might otherwise make it difficult to attain said substantially accurate attitude of said members in the absence of said machined nonmetallic base means.

The invention is also embodied in means for precision mounting of members on an elongate, metallic supporting structure, comprising said metallic supporting structure being formed to have at least minimal warpage and having an area along substantially the full length of said supporting structure prepared for receiving nonmetallic mounting base means, easily machinable nonmetallic mounting base means applied to and extending in the form of a continuous strip covering said area, said mounting base means comprising a material which is substantially free from tendency to warp during machining, means securing said mounting base means fixedly onto said area, and said mounting base means having an exposed receiving surface substantially accurately machined after securing of said mounting base means onto said area, for facilitating receiving and mounting said members on said surface in predetermined substantially accurate attitude unaffected by irregularities that may be present in said area, and which irregularities might otherwise make it difficult to attain said substantially accurate attitude of said members in the absence of said machined nonmetallic base means.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure and in which:

FIG. 1 is a side elevational schematic view partially in section showing a paper making machine forming apparatus embodying principles of the present invention.

FIG. 2 is a more or less schematic side elevational view of one of the forming board bars showing steps in the preparation of the same for receiving water stripping or drainage foils.

FIG. 3 is a fragmentary enlarged cross-sectional view showing metallic supporting structure of one of the forming board bars.

FIG. 4 is a view similar to FIG. 3, but showing the bar structure with easily machinable nonmetallic mounting base means applied thereto.

FIG. 5 is a view similar to FIG. 4, but showing the mounting base means after machining thereof in preparation for receiving the water stripping foil members thereon; and FIG. 6 is a view similar to FIG. 5, but showing the forming bar with the water stripping foils mounted thereon.

By way of example, FIG. 1 illustrates the forming zone in the wet end of a paper making machine wherein a pervious travelling forming wire 10 such as a fourdrinier wire runs in stretched relation over a breast roll 11 and has an upper forming run receiving paper making stock from a slice opening 12 of a headbox 13. Downstream from the headbox forming board means in underlying cooperation with the wet paper web carrying forming wire are located at an optimum position relative to the breast roll 11 and the location where the paper stock is discharged onto the wire for effectively stripping water which has drained through the forming wire from the paper making pulp carried by the wire. In a preferred form, the forming board 14 comprises a plurality of successively operating spaced, substantially identical elongate water strippers 15. Customarily, three or four of the strippers 15 are employed, three being the preferred number in the illustrated example. Each of the strippers 15 comprises an elongate metallic mounting structure in the form of a bar 17 carried by suitable frame structure 18 to which the bar, which may be stainless steel, or other ferrous material, is secured as by means of welding 19 (FIG. 3). Each of the bars 15 carries a plurality of foil elements 20 formed of any suitable material such as ceramic and mounted in close side by side relation along the length of the bar, being secured to the bar by means of a dove tail key strip 21 secured as by means of screws 22 onto the top of the bar 17.

Because of the width of modern day paper making machines wherein the breast roll 11 and the strippers 15 may be as much as thirty feet long, the problem of sag or catenary tendency must be reconciled in the strippers 15 vis-a-vis the breast roll 11 in order to assure that the screen 10 will travel smoothly across the strippers 15 after leaving the breast roll 11.

According to the principles of the present invention, this problem is overcome efficiently by in effect rough machining the elongate thin supporting bars 17 (FIG. 3), applying and fixedly securing to a facing area of the bars 17 easily machinable nonmetallic mounting base means 23 such as fiberglass (FIG. 4), machining the mounting base means 23 as necessary to attain the desired results (FIGS. 2 and 5) and then mounting the foil members 20 on the bar 17 with the mounting base means 23 interposed between the bar and the foils.

In the preliminary stages of fabricating each of the strippers 15, the bar 17 is at least rough formed including any necessary machining to provide desired cross-sectional shape, and welded onto the frame means 18. In forming the bar 17, it is provided with a top supporting area 24 facing upwardly, a rear substantially vertical area 25 and a front edge undercut 27, with a forwardly projecting lip 28 extending entirely along the front edge of the bar 17 and defining the top of the undercut 27. To prepare the bar 17 for receiving and securing the base means 23 to the bar, the areas of the top surface 24, the back surface 25 and the tongue 28 including the undercut 27 are treated, for example, by shot blasting, indicated schematically in FIGS. 3–6 by a rough texture of those surface areas. Advantageously, only reasonable attention to avoiding excessive warpage during fabrication of the bar 17 and during welding of the bar to the frame 18 need be exercised, in contrast to prior practice where the foils have been mounted directly on the bar 17 without any intervening mounting base means and which required as nearly warp-free machining as practicable. As a practical matter, freedom from warpage was never attained and is virtually impossible of attainment in machining a long slender metal bar.

After the bar 17 has been fabricated and prepared to receive the base means 23, and the bar has been welded onto the supporting frame means 18, the base means 23 is applied to the bar. Such application may be effected by molding the base means 23 directly in place on the bar 17, whereby the natural adhesiveness of the material of the base means 23 during the forming and curing thereof will cause the base means to adhere to the prepared surface areas of the bar 17. In such instance, the shot blasted surfaces will provide increased surface area means for securing the mounting base means fixedly onto the prepared surface areas. If desirable or necessary, a suitable bonding agent may be applied to the receptive surface areas whereby to improve adherence of the base means 23 to the bar 17. If it is preferred to premold the base means 23 as a shell or cap to be applied to the bar 17, that may be done and then a cementing material applied to the interface surfaces of the bar 17 and the base means 23 to effect securement of one to the other. Whatever means are employed for securing the mounting base means 23 to the bar 17, is identified in FIGS. 4, 5 and 6 by the reference 29. In the assembly of the bar 17 with the base means 23, the most important area to be covered by the base means 23 is, of course, the principle facing area 24 of the bar 17. In addition in order to enhance anchorage of the base means 23 to the bar 17, a depending integral flange 30 extends from the rear portion of the main body of the base means 23 and laps the substantially vertical surface 25 of the bar 17. In addition, a front rib portion 31 on the base means 23 has a rearwardly opening channel or groove 22 complementary to and within which the tongue 28 of the bar 17 is received, with a rearwardly extending lower flange 33 on the rib 31 lapping the underside of the tongue 28 and extending into the undercut 27. In its initially fabricated form, the base means 23 provides at least in its top body portion sufficient thickness of material to permit substantial machining to attain an accurate desired top receiving surface for the foil members 20.

In preparing the receiving surface, i.e. the top surface, of the supporting means 23 for accurately receiving the foil members 20 having regard to the forming wire 10 as it leaves the breast roll 11, the amount of downward bow or catenary deflection or upward bow of the breast roll is determined. The bar 17 with the mounting base means 23 mounted thereon is then supported in the same manner as it will be supported in the paper making machine organization, that is at least at its opposite ends as indicated by the directional arrows 34 in FIG. 2, permitting the bar to assume the intermediately downwardly bowed condition which it would normally assume due to its long thin, that is cross-sectionally small mass structure. Such bowed condition will normally be greater than the intermediate bowed condition of the couch roll 11 which is of many times greater mass and thus more resistant to intermediate bowing deflection. For example, when freely supported at its ends as indicated at 34, the bar 17 may have a bow deflection of 0.06 inch at the center. On the other hand, the downward bow deflection of the roll 11 may be only 0.01 inch. Accordingly, for machining, support is provided for the bar 17 by the supports 34, and the center of the bar 7 is supported as indicated by the directional arrow 35 to have a downward bow deflection of only 0.05 inch. Then the top of the mounting base means 23 is machined in a flat plane 37 along its entire length. Upon release from the center support 35, the bar 17 will assume its normal bowed relation which will drop the machined receiving surface 37 of the mounting base mean to a bowed relation of 0.01 inch down at the center, corresponding to the downwardly bowed condition of the roll 11. Inasmuch as the material of the mounting base means 23 is unaffected by heat warpage as a result of the machining, the machined receiving surface 37 will be quite accurate in the finished product.

Should it be desired to have an upwardly projecting bowed relationship of say 0.01 inch to correspond to a similarly upwardly bowed condition of the roll 11, a downward thrust or pull is applied on the bar 17, as indicated by the directional arrow 38, to effect a 0.07 inch bow. This will result, after the mounting base means 23 has been machined with a flat plane top surface, and the bar 17 is released from the downward pressure or thrust, in a spring back to 0.01 inch upward bow deflection in the top, receiving surfaces of the mounting base means 23, corresponding to that of the roll 11.

Some clean-up machining may be effected on the outer exposed surface of the flange 30 if desired. In order to facilitate water deflection and drainage, the underside of the rib 31 is desirably chamfered as indicated at 39 in FIG. 5, to lead into the similarly downwardly and rearwardly chamfered front edge 40 the bar 17 below the undercut 27.

To receive the foil attaching screws 22, the bar 17 and the mounting base means 23 are provided with respective aligned screw holes 41 in which the portion of the screw holes in the bar 17 may be tapped for receiving the screw thread.

Each of the several sections of the foil 20 is accurately formed so that when the foil sections are mounted on the prepared receiving surface 37, the foil will have its leading edge 42 in the proper bowed condition along its edge, conforming substantially to the bowed condition of the receiving surface 37, and thus the transverse condition of the forming wire 10 which conforms to the bowed condition of the roll 11. Anchorage of the sections of the foil 20 is effected by means of the dovetail strip 21 engaging in complementary dovetail downwardly opening groove 43 in the foil and secured to the bar 17 by means of the screws 22.

From the foregoing, it will apparent that there has been provided a new and improved method of and means for attaining the objects and advantages above setforth. The members, i.e., the foils, mounted on the elongate metal supporting structure, i.e. the bar 17, are carried by the substantially accurately machined receiving surface 37 of the mounting base means interposed between the members and the supporting structure unaffected by any irregularities that may be present in the supporting area, i.e. the area 24 of the bar 17, and which irregularities might otherwise make it difficult to attain the desired substantially accurate attitude of of the members in the absence of the machined nonmetallic base means.

It will be understood that variations and modifications may be effected without departing from the spirit and scope of the novel concepts of this invention.

I claim as my invention:

1. A method of precision mounting for members on an elongate metallic supporting structure, comprising:

forming said metallic supporting structure in a manner avoiding excessive warpage;

preparing a facing area along substantially the full length of said supporting structure for receiving mounting base means on said area;

applying and fixedly securing to said area mounting base means comprising easily machinable nonmetallic material which is substantially free from tendency to warp during machining and extending in the form of a continuous strip covering said area;

and after said applying and securing of said base means substantially accurately machining an exposed receiving surface on said base means for receiving and mounting said members on said receiving surface in a predetermined substantially accurate attitude unaffected by irregularities that may be present in said area and which irregularities might otherwise make it difficult to attain said substantially accurate attitude of said members in the absence of said machined nonmetallic base means.

2. A method according to claim 1, comprising preparing said facing area by subjecting it to steel shot blasting treatment.

3. A method according to claim 1, comprising applying a bonding means between said metallic support structure and said mounting base means.

4. A method according to claim 1, wherein said metallic supporting structure comprises a bar having front and rear edges along said area, and forming said mounting base means to engage not only said area but also said front and rear edges.

5. A method according to claim 1, comprising forming said elongate metallic supporting structure with a tongue running along one longitudinal edge thereof, and forming said mounting base means with a groove complementary to and within which said tongue is received.

6. A method according to claim 5, comprising forming said mounting base means with an angular flange, and engaging said angular flange with an opposite edge on said metallic supporting structure.

7. A method according to claim 1, comprising supporting said metallic supporting structure at opposite ends thereof so that the metallic supporting structure and the mounting base means assume a downwardly bowed condition, and machining said mounting base means to provide said receiving surface bowed differently from the bowed condition of said supporting structure.

8. A method according to claim 7, comprising supporting said metallic supporting structure in a predetermined bowed relation less than the normal bowed relation of the metallic supporting structure when freely supported between its ends, machining said base means to form said receiving surface in a flat plane, and releasing said metallic structure to assume its normal bowed condition.

9. A method according to claim 7, comprising supporting said metallic supporting structure in a predetermined bowed relation greater than the normal bowed relation of the metallic supporting structure when freely supported between its ends, machining said base means to form said receiving surface in a flat plane, and releasing said metallic structure to assume its normal bowed condition.

10. An elongate metallic supporting structure having means for precision mounting of members thereon, comprising:

said metallic supporting structure being formed to avoid excessive warpage and having a facing area along substantially the full length of said supporting structure prepared for receiving nonmetallic mounting base means;

easily machinable nonmetallic mounting base means applied to and extending in the form of a continuous strip covering said area, said mounting base means comprising a material which is substantially free from tendency to warp during machining;

means securing said mounting base means fixedly onto said area;

and said mounting base means having an exposed receiving surface substantially accurately machined after securing of said mounting base means onto said area, for facilitating receiving and mounting of said members on said surface in predetermined substantially accurate attitude unaffected by irregularities that may be present in said area, and which irregularities might otherwise make it difficult to attain said substantially accurate attitude of said members in the absence of said machined nonmetallic base means.

11. Structure according to claim 10, wherein said facing area has been steel shot blasted.

12. Structure according to claim 10, including bonding means between said metallic supporting structure and said mounting base means.

13. Structure according to claim 10, wherein said metallic supporting structure comprises a bar having front and rear edges along said area, and said mounting base mean engages not only said area but also said front and rear edges.

14. Structure according to claim 10, wherein said elongate metallic supporting structure has a tongue running along one longitudinal edge thereof, and said mounting base means has a groove complementary to and within which said tongue is received.

15. Structure according to claim 14, wherein said mounting base means has an angular flange spaced from said groove, said angular flange being juxtaposed to a surface of said metallic supporting structure angular to said facing area.

16. Structure according to claim 10, wherein said metallic supporting structure is supported at its opposite ends and has a normally downwardly bowed condition due to its length and relatively small cross-sectional mass, and said machined receiving surface of said mounting base means is bowed differently from the bowed condition of said supporting structure.

17. Structure according to claim 16, wherein said receiving surface is bowed in the same direction as, but less than said normal bowed condition of said metallic supporting structure.

18. Structure according to claim 16, wherein said receiving surface is bowed in the opposite direction from said bowed condition of said supporting surface.

* * * * *